US009260819B2

(12) United States Patent
Oouchi et al.

(10) Patent No.: US 9,260,819 B2
(45) Date of Patent: Feb. 16, 2016

(54) PRESS FELT FOR PAPERMAKING

(71) Applicant: Ichikawa Co., Ltd., Bunkyo-ku (JP)

(72) Inventors: Takashi Oouchi, Tokyo-to (JP); Shigeyuki Okamoto, Tokyo-to (JP); Yasuhiko Kobayashi, Tokyo-to (JP); Yasuyuki Ogiwara, Tokyo-to (JP); Masashi Kato, Tokyo-to (JP)

(73) Assignee: Ichikawa Co., Ltd., Bunkyo-ku (JP)

( * ) Notice: Subject to any disclaimer, the term of this patent is extended or adjusted under 35 U.S.C. 154(b) by 0 days.

(21) Appl. No.: 14/163,195

(22) Filed: Jan. 24, 2014

(65) Prior Publication Data

US 2014/0202649 A1 Jul. 24, 2014

(30) Foreign Application Priority Data

Jan. 24, 2013 (JP) ..... 2013-023750

(51) Int. Cl.
*D21F 7/08* (2006.01)
*D03D 13/00* (2006.01)

(52) U.S. Cl.
CPC *D21F 7/08* (2013.01); *D21F 7/083* (2013.01); *D03D 13/00* (2013.01)

(58) Field of Classification Search
CPC ..... D21F 1/10; D21F 1/0027; D21F 1/0036; D21F 1/0054; D21F 1/105; D21F 7/08; D21F 7/083; D21F 7/10; D21F 7/12; D03D 1/0094; D03D 3/04; D03D 11/00; D03D 13/00; D03D 25/00
USPC ..... 162/348, 358.2, 900, 902–904; 139/383 A, 383 AA, 425 A
See application file for complete search history.

(56) References Cited

U.S. PATENT DOCUMENTS

| | | | | |
|---|---|---|---|---|
| 4,314,589 | A * | 2/1982 | Buchanan et al. | 139/383 A |
| 7,108,019 | B2 * | 9/2006 | Nagura et al. | 139/383 A |
| 2007/0125911 | A1 * | 6/2007 | Heger et al. | 245/2 |
| 2009/0014083 | A1 * | 1/2009 | Gstrein et al. | 139/383 AA |
| 2011/0186256 | A1 * | 8/2011 | Mikkonen et al. | 162/358.2 |

FOREIGN PATENT DOCUMENTS

| | | |
|---|---|---|
| EP | 0 549 917 A1 | 7/1993 |
| EP | 1 722 033 A1 | 11/2006 |
| JP | 6-146191 | 5/1994 |
| JP | 2006-265816 | 10/2006 |
| JP | 2009-155747 | 7/2009 |

OTHER PUBLICATIONS

Extended European Search Report issued Apr. 8, 2014 in Patent Application No. 14000253.6.

* cited by examiner

*Primary Examiner* — Eric Hug
(74) *Attorney, Agent, or Firm* — Oblon, McClelland, Maier & Neustadt, L.L.P.

(57) ABSTRACT

A felt that further equalizes a pressure state under pressurization by a press so as to smooth the surface of a wet paper web without causing marking on the surface thereof and allow water to be uniformly squeezed out from the wet paper web without crushing the wet paper web is provided by a papermaking press felt wherein a difference between a maximum value and a minimum value of an interval between an upper knuckle portion and an upper knuckle portion, an interval between upper and lower knuckle portions, or an interval between a lower knuckle portion and a lower knuckle portion is arranged to be a value corresponding to 1.0 piece or less of an upper warp yarn in a base fabric.

5 Claims, 17 Drawing Sheets

PRESS FELT FOR PAPERMAKING

CROSS REFERENCE TO RELATED APPLICATIONS

This application claims the benefit of priority on from the prior Japanese Patent Application No. 2013-023750 filed on Jan. 24, 2013, the entire disclosure of which is incorporated herein by reference.

FIELD OF THE INVENTION

The present invention relates to a basic fabric of a papermaking press felt (hereinafter referred to simply as "felt") used in papermaking machines.

BACKGROUND ART

Papermaking machines removing water from raw material of paper are generally provided with a wire part, a press part, and a dryer part. The wire part, the press part, and the dryer part are arranged in this order in a direction in which a wet paper web is conveyed.

The wet paper web transferred from the wire part to the press part is conveyed usually by a felt including batt layers needled onto a base fabric and then pressed together with the felt by a roll press or a shoe press mechanism to remove water inside the wet paper web.

The felt is generally formed by intertwining and integrating a batt fiber with the base fabric by needling. The base fabric used is generally a woven fabric woven by a weaving machine. As methods for producing a woven fabric, there are hollow weaving and plain weaving. The hollow weaving is a method in which warp yarns on a weaving machine (warping yarns, which are weft yarns of felt (CMD yarns: Cross-Machine-Direction yarns)) and weft yarns on the weaving machine (interwoven yarns, which are warp yarns of the felt (MD yarns: Machine-Direction yarns)) are woven in a loop shape (in an endless shape) in advance. In addition, plain weaving is a method in which warp yarns on a weaving machine (warping yarns, which are warp yarns of felt (MD yarns: Machine-Direction yarns)) and weft yarns on the weaving machine (woven yarns, which are weft yarns of the felt (CMD yarns: Cross-Machine-Direction yarns)) are woven up into a woven fabric in such a manner that the length of a warp yarn direction of the woven fabric is equal to the length of a running direction of the felt in a papermaking machine. In this method, both ends of the woven fabric woven up are bonded together (sewed together) to form the woven fabric into a loop shape (for convenience, hereinafter, warp yarn and weft yarn, respectively, are referred to as warp yarn (MD yarn) and weft yarn (CMD yarn), respectively, of felt.

Functions required for the felt include equalizing a pressure state under pressurization by a press so as to smooth the surface of a wet paper web without causing marking on the surface thereof and uniformly squeeze water out from the wet paper web without crushing the wet paper web. In addition, the functions required for the felt also include reducing time from setting of a felt in a papermaking machine and starting of use of the felt to reaching a normal operation speed, namely an attunement time, and stabilizing running.

In Patent Literature 1, in order to simultaneously suppress both a stripe-like marking in a warp yarn direction and a stripe-like marking in a weft yarn direction to further improve surface properties of paper, there has been disclosed a felt using a base fabric composed of a woven fabric that has a double warp-single weft texture structure consisting of an upper warp yarn on a paper surface side of the fabric, a lower warp yarn on a running surface side thereof, and weft yarns interwoven by double weaving so as to be intertwined with both the upper and the lower yarns, in which the upper yarn is interwoven in a higher density than the lower warp yarn. In the base fabric, the upper warp yarn is composed of a soft twist yarn of a plurality of filaments softly twisted so as to be flattenable and the weft yarns are interwoven such that knuckle portions in each of which the weft yarns bend in such a manner as to pass along the upper side of only one upper piece of the upper yarn are arranged at an equal interval corresponding to three or more upper yarns.

In Patent Literature 2, in order to provide a press felt that does not cause any marking nor crush, there has been disclosed a felt using a base fabric composed of a set of top-side MD yarns, a set of bottom-side MD yarns, and a set of CMD yarns interwoven with the top-side MD yarns and the bottom-side MD yarns. In the base fabric, the top-side MD yarns, the bottom-side MD yarns, and the CMD yarns are interwoven in a series of repeating units in which each of the top-side MD yarns forms a long MD paper-side float yarn above specific consecutive plural ones of the set of CMD yarns.

Patent Literature 3 has disclosed a papermaking felt in which the number of pieces of MD yarns on the upper surface of a base fabric is twice the number of pieces of MD yarns on the lower surface thereof in order to provide a woven fabric having a high vibration absorbing capacity used in papermaking machines so as to provide a felt having high elasticity and resilience to assure better runnability, fewer maintenance stops, and improved paper quality.

PRIOR ART REFERENCES

Patent Literature

[Patent Literature 1]: Japanese Unexamined Patent Application Publication No. 2009-155747

[Patent Literature 2]: Japanese Unexamined Patent Application Publication No. 2006-265816

[Patent Literature 3]: Japanese Unexamined Patent Application Publication No. H6-146191

SUMMARY OF THE INVENTION

In Patent Literature 1 to 3 above, studies were conducted about the interval between upper knuckle portions formed by the upper warp yarn (the top-side MD yarn or the machine-direction yarn on the upper surface) and the weft yarns (the CMD yarns or the cross-machine-direction yarns) of the base fabric, the number of the knuckle portions, the repeating patterns thereof, and the like to provide a felt that equalizes a pressure state under pressurization by a press so as to smooth the surface of a wet paper web without causing marking on the surface thereof and uniformly squeezing water out from the wet paper web without crushing the wet paper web, as functions required for felt. However, the felts disclosed in these prior art documents were not considered the influence of lower knuckle portions formed by the lower warp yarn (the bottom-side MD yarn or the machine-direction yarn on the lower surface) and the weft yarns (the CMD yarns or the cross-machine-direction yarns) of the base fabric upon the above functions required for the felt. Accordingly, there is a nonuniformity of density between the upper knuckle portions and the lower knuckle portions, thereby making unequal the pressure state under pressurization by a press. Furthermore, in the woven fabric in which the upper warp yarn is interwoven in a higher density than the lower warp yarn, the lower warp yarn usable can be a thicker yarn than the upper warp yarn. In this case, however, the influence of the lower knuckle portions upon the above functions required for the felt becomes more remarkable.

In order to solve the problem of the prior art described above, an object of the present invention is to provide a felt that further equalizes a pressure state under pressurization by a press so as to smooth the surface of a paper wet web without causing marking on the surface thereof and allow water to be uniformly squeezed out from the wet paper web without crushing the wet paper web.

In order to solve the problem, the inventors of the present invention intensively and extensively studied the intervals between knuckle portions, the number of the knuckle portions, and repeating patterns regarding both upper and lower knuckle portions that will be factors influencing the above felt functions.

Specifically, the present invention is based on the following techniques:

[1] A papermaking press felt including a base fabric consisted of a woven fabric having a warp-weft texture structure that includes an upper warp yarn on a wet paper web side of the fabric, a lower warp yarn on a running surface side thereof, and weft yarns interwoven in such a manner as to be intertwined with both the upper and the lower warp yarns, the upper warp yarn being interwoven in a number of pieces larger than the lower warp yarn, wherein the base fabric has, in a unit texture, at least one upper knuckle portion in which the weft yarns bend so as to pass along the upper side of only one piece of the upper warp yarn and at least one lower knuckle portion in which the weft yarns bend so as to pass along the lower side of only one piece of the lower warp yarn, and a difference between a maximum value and a minimum value of an interval between the upper knuckle portion and the upper knuckle portion, an interval between the upper knuckle portion and the lower knuckle portion, or an interval between the lower knuckle portion and the lower knuckle portion is a value corresponding to 1.0 piece or less of the upper warp yarn.

[2] The papermaking press felt according to the [1], wherein the texture structure of the base fabric having a double warp-single weft texture structure that comprises an upper warp yarn on a wet paper web side of the fabric, a lower warp yarn on a running surface side thereof, and weft yarns interwoven in such a manner as to be intertwined with both the upper and the lower warp yarns.

[3] The papermaking press felt according to any one of the [1] or the [2], in which the lower knuckle portions of the base fabric are not adjacent to each other but are distributedly arranged.

[4] The papermaking press felt according to any one of the [1] to the [3], in which the lower knuckle portions of the base fabric are distributedly arranged as a pair of two adjacent ones shifted from each other by an interval corresponding to one piece of the lower warp yarn.

[5] The papermaking press felt according to any one of the [1] to the [4], in which the lower knuckle portions of the base fabric are distributedly arranged as a set of four adjacent ones shifted from each other by an interval corresponding to one piece of the lower warp yarn.

[6] The papermaking press felt according to any one of the [1] to the [5], in which the base fabric has, in the unit texture, one upper knuckle portion in which the weft yarns bend so as to pass along the upper side of only one piece of the upper warp yarn and one lower knuckle portion in which the weft yarns bend so as to pass along the lower side of only one piece of the lower warp yarn.

[7] The papermaking press felt according to any one of the [1] to the [5], in which the base fabric has, in the unit texture, two upper knuckle portions in each of which the weft yarns bend so as to pass along the upper side of only one piece of the upper warp yarn and one lower knuckle portion in which the weft yarns bend so as to pass along the lower side of only one piece of the lower warp yarn.

[8] The papermaking press felt according to any one of the [1] to the [5], in which the base fabric has, in the unit texture, two upper knuckle portions in each of which the weft yarns bend so as to pass along the upper side of only one piece of the upper warp yarn and two lower knuckle portions in each of which the weft yarns bend so as to pass along the lower side of only one piece of the lower warp yarn.

[9] The papermaking press felt according to any one of the [1] to the [5], in which the base fabric has, in the unit texture, three upper knuckle portions in each of which the weft yarns bend so as to pass along the upper side of only one piece of the upper warp yarn and one lower knuckle portion in which the weft yarns bend so as to pass along the lower side of only one piece of the lower warp yarn, and two upper knuckle portions in each of which the weft yarns bend so as to pass along the upper side of only one piece of the upper warp yarn and two lower knuckle portions in each of which the weft yarns bend so as to pass along the lower side of only one piece of the lower warp yarn.

[10] The papermaking press felt according to any one of the [1] to the [9], in which a difference between a maximum value and a minimum value of an interval between the upper knuckle portion and the upper knuckle portion, an interval between the upper knuckle portion and the lower knuckle portion, or an interval between the lower knuckle portion and the lower knuckle portion is a value corresponding to 0.5 pieces or less of the upper warp yarn.

[11] The papermaking press felt according to any one of the [1] to the [10], wherein the texture structure of the base fabric consists of the upper warp yarn on the wet paper web side, the lower warp yarn on the running surface side, and an intermediate warp yarn arranged between the upper and the lower warp yarns and has a triple warp-single weft texture structure in which the weft yarns are interwoven so as to be intertwined with each of the upper warp yarn, the lower warp yarn, and the intermediate warp yarn.

According to the above structures, there can be provided a felt that further equalizes a pressure state under pressurization by a press so as to smooth the surface of a wet paper web without causing marking on the surface thereof and uniformly squeeze water out from the wet paper web without crushing the wet paper web, as the functions required for felt.

MODES FOR CARRYING OUT THE INVENTION

According the present invention, "upper" means a wet paper web side of the papermaking press felt, and "lower" means a running surface side thereof.

Hereinafter, a detailed description will be given of preferable embodiments of a papermaking press felt according to the present invention with reference to the drawings.

Figure 1:
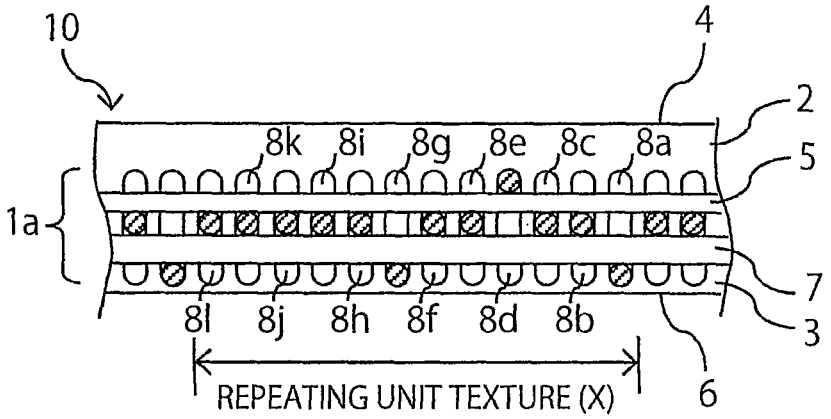
FIG. 1 is a cross-sectional view of a warp yarn direction in one example of a felt according to the present invention.
Figure 2A:
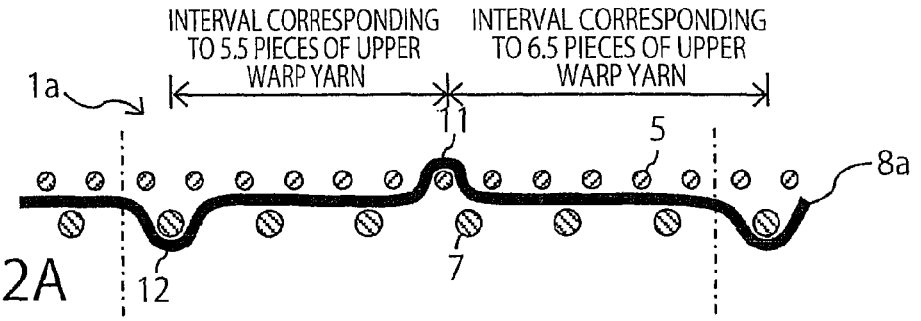
FIGS. 2A to 2L are cross-sectional views of weft yarn directions of a base fabric depicted in FIG. 1.
Figure 2B:
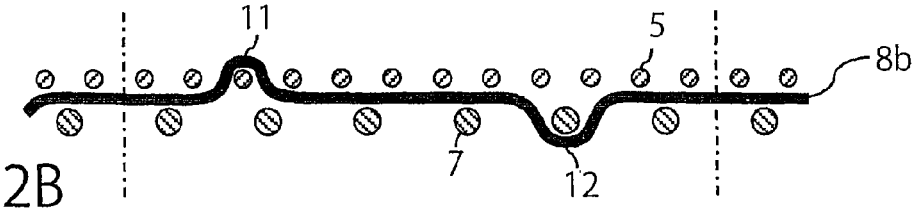
Figure 2C:
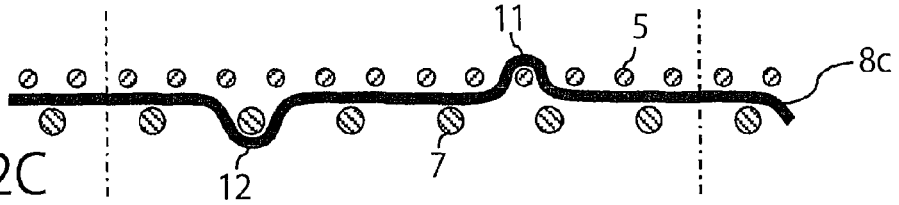
Figure 2D:
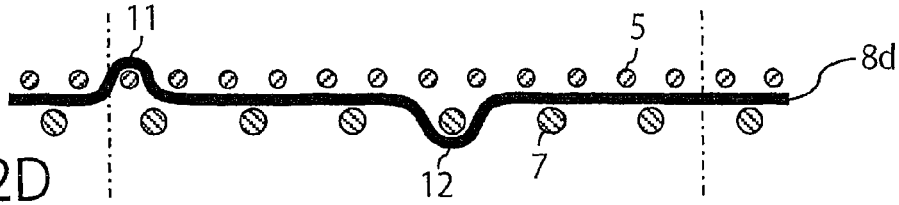
Figure 2E:
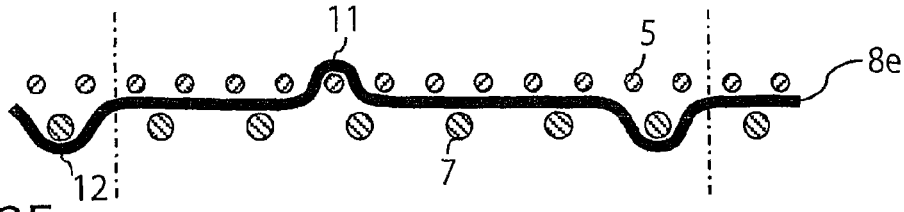
Figure 2F:
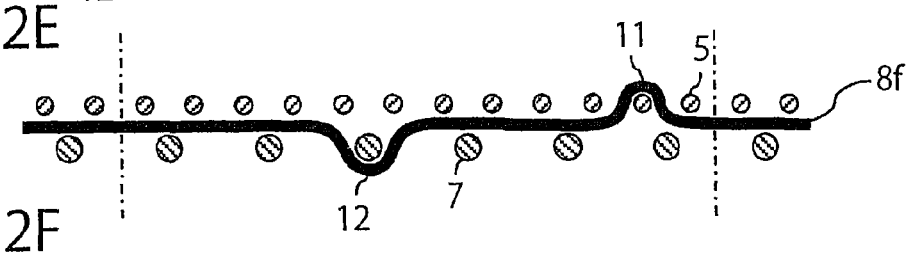
Figure 2G:
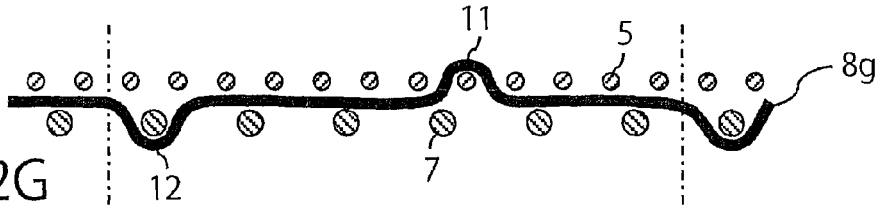
Figure 2H:
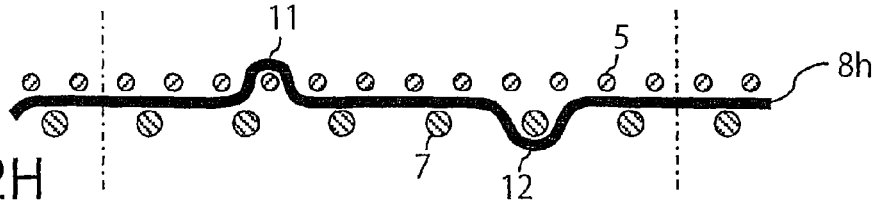
Figure 2I:
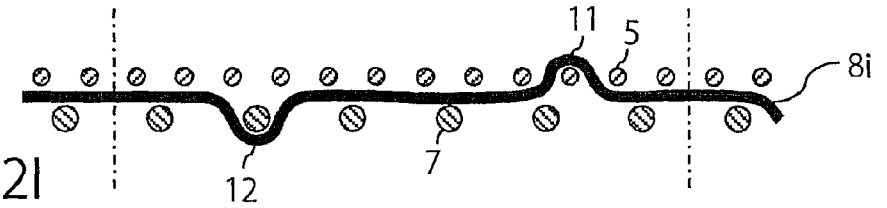
Figure 2J:
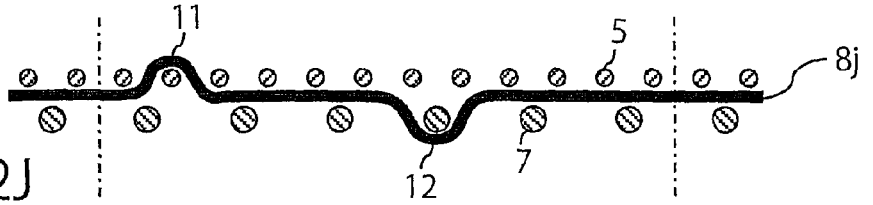
Figure 2K:
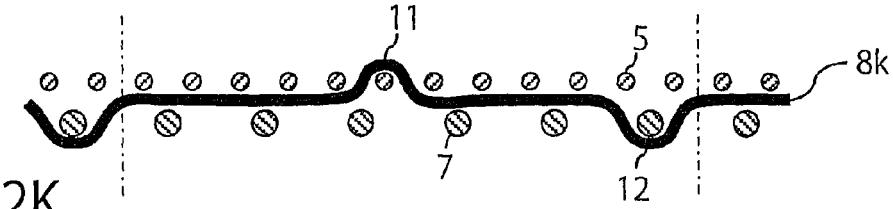
Figure 2L:
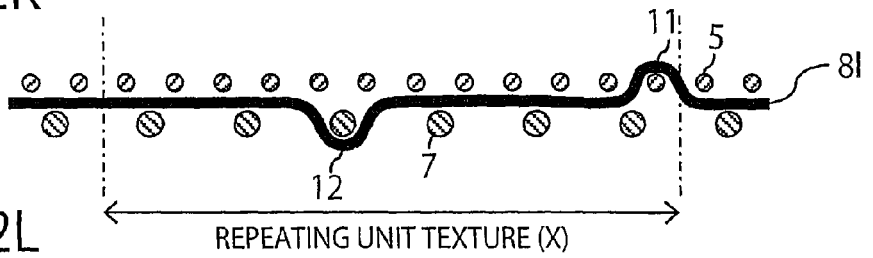
Figures 3A, 3B, 3C:
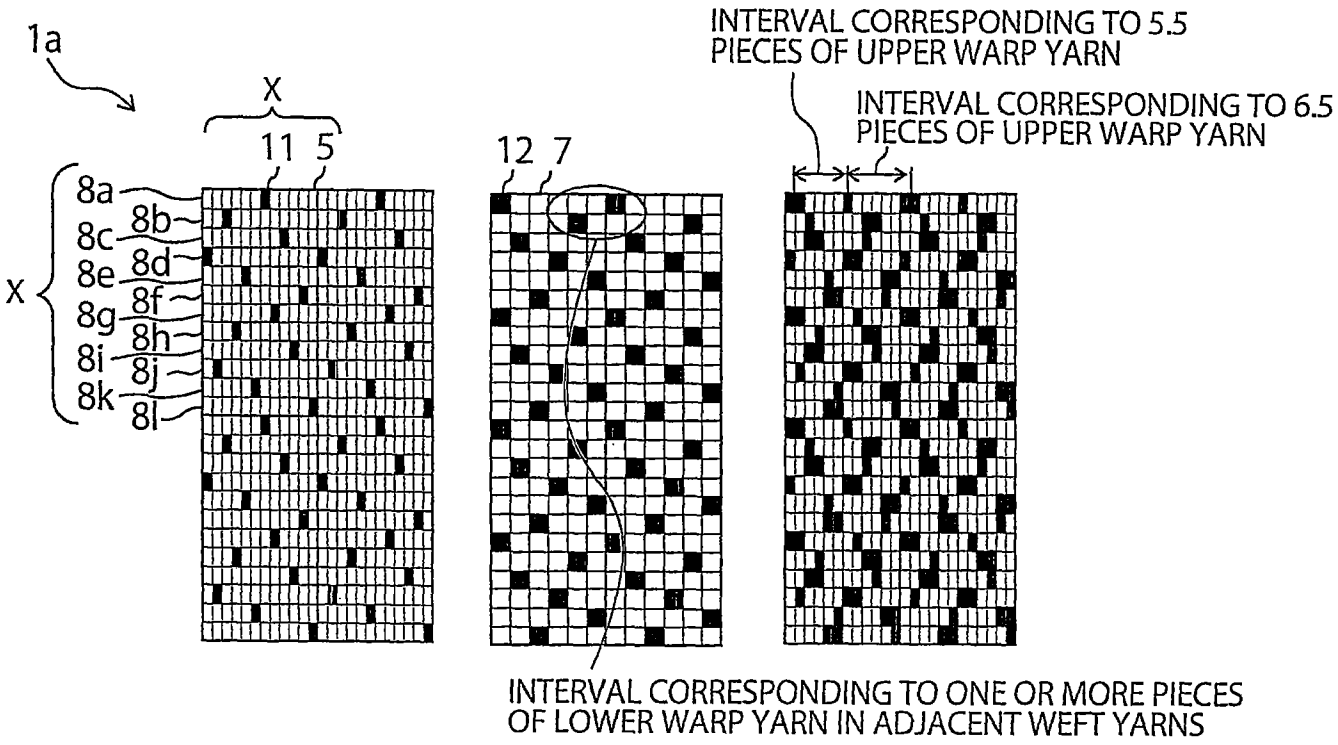
FIGS. 3A to 3C are schematic diagrams indicating positional relationships between knuckle portions of the base fabric depicted in FIG. 1.

FIG. 1 is a cross-sectional view of a warp yarn direction in one example of the felt according to the present invention. FIGS. 2A to 2L are cross-sectional views of weft yarn directions of a base fabric of the felt depicted in FIG. 1. FIGS. 3A, 3B, and 3C, respectively, are schematic diagrams indicating an upper knuckle portion 11 on a wet paper web side of the base fabric depicted in FIG. 1, a lower knuckle portion 12 on a running surface side thereof, and a positional relationship between the upper knuckle portion 11 on the wet paper web side thereof and the lower knuckle portion 12 on the running surface side thereof.

As depicted in FIG. 1, a felt 10 is composed of a base fabric 1*a*, a front batt fiber layer 2, and a back batt fiber layer 3. Usually, the front batt fiber layer 2 and the back batt fiber layer 3 are intertwined and integrated with the base fabric is by a needling process. The back batt fiber layer 3 may be omitted.

The base fabric 1*a* has a double warp-single weft texture structure consisting of an upper warp yarn 5 on a wet paper web side 4 of the fabric where a wet paper web will be placed, a lower warp yarn 7 on a running surface side 6 thereof that will contact with rolls and the like of a papermaking machine, and weft yarns 8*a* to 8*l* interwoven so as to be intertwined with both the upper warp yarn 5 and the lower warp yarn 7. The weft yarns 8*a* to 8*l* are interwoven as depicted in FIGS. 2A to 2L to form a unit texture by the 12 pieces of the weft yarns. The unit texture (X) is repeated in a warp yarn direction and a weft yarn direction to form a texture structure.

The upper warp yarn 5 is interwoven in a number of pieces twice the number of pieces of the lower weft yarn 7, whereby smoothness of the surface of the wet paper web side 4 of the base fabric 1*a* can be improved, thus allowing the surface of the wet paper web to be smoothed. In addition, the upper layer of the base fabric composed of the upper warp yarn 5 has water permeability lower than that of the lower layer of the base fabric composed of the lower warp yarn 7. Accordingly, water moving from the base fabric upper layer to the base fabric lower layer hardly moves back again to the base fabric upper layer. This can consequently suppress a rewetting phenomenon in which water moves from the wet paper web side 4 to the wet paper web immediately after dewatering the wet paper web. In addition, by using the upper warp yarn 5 made of a thinner yarn material than the lower warp yarn 7, the surface smoothness and the suppression of the rewetting phenomenon can be more significantly achieved.

Herein, as the function required for felt, in order to equalize a pressure state when pressurized by a press so as to cause no marking on the surface of the wet paper web, to smooth the surface of the wet paper web, to cause no crushing of the wet paper web, and to uniformly squeeze water out from the wet paper web, it is important to consider a positional relationship between the upper knuckle portion 11 and the lower knuckle portion 12 in the repeating texture structure of the base fabric.

FIG. 3A is a schematic diagram indicating a positional relationship between the upper knuckle portions 11 on the wet paper web side 4 of the base fabric depicted in FIG. 1, and FIG. 3B is a schematic diagram indicating a positional relationship between the lower knuckle portions 12 on the running surface side 6 of the base fabric depicted in FIG. 1. FIG. 3C is a schematic diagram indicating a positional relationship between the upper knuckle portions 11 on the wet paper web side of the base fabric depicted in FIG. 1 and the lower knuckle portions 12 on the running surface side thereof depicted in FIG. 1.

As depicted in FIG. 3C, in each of the weft yarns 8*a* to 8*l* in the unit texture structure, the base fabric 1*a* has one upper knuckle portion 11 formed by each of the weft yarns 8*a* to 8*l* and the upper warp yarn 5 and one lower knuckle portion 12 formed by each of the weft yarns 8*a* to 8*l* and the lower warp yarn 7. Then, a maximum value and a minimum value, respectively, of the interval between the upper knuckle portion 11 and the lower knuckle portion 12 are 6.5 pieces and 5.5 pieces, respectively, of the upper warp yarn 5 and the difference therebetween is 1.0 piece. Accordingly, it can be seen that the upper knuckle portion 11 and the lower knuckle portion 12 are arranged substantially uniformly in the weft yarn direction. In addition, it can be seen that, in the adjacent weft yarns, the lower knuckle portions 12 are arranged at an interval corresponding to one or more pieces of the lower warp yarn 7 and thus are not adjacent to each other but distributedly arranged.

By using, for felt, the base fabric having the unit texture in which the upper knuckle portion 11 and the lower knuckle portion 12 are arranged in this manner, there can be provided a felt that can equalize a pressure state when pressurized by a press so as to smooth the surface of a wet paper web without causing marking on the surface thereof and allow water to be uniformly squeezed out from the wet paper web without crushing the wet paper web.

Next, a description will be given of application examples of the present invention based on the double warp-single weft texture structure as in FIGS. 1 to 3.

Figures 4A, 4B, 4C:
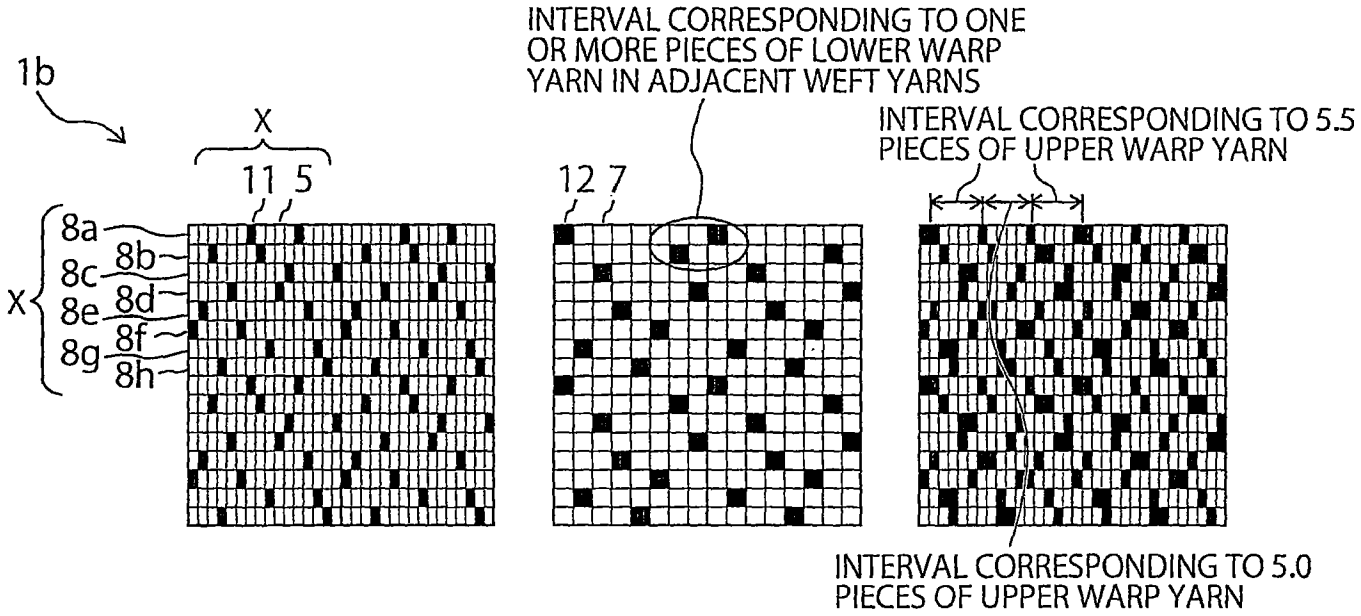
FIGS. 4A to 4C are schematic diagrams indicating positional relationships between knuckle portions of a base fabric of another example of the felt according to the present invention.

FIGS. 4A to 4C are schematic diagrams indicating positional relationships between the upper knuckle portion 11 on the wet paper web surface side 4 of a base fabric 1*b* and the lower knuckle portion 12 on the running surface side 6 thereof in another example of the felt according to the present invention. As depicted in FIG. 4C, in each of the weft yarns 8*a* to 8*h* in the unit texture structure, the base fabric 1*b* has two upper knuckle portions 11 formed by each of the weft yarns 8*a* to 8*h* and the upper warp yarn 5 and one lower knuckle portion 12 formed by each of the weft yarns 8*a* to 8*h* and the lower warp yarn 7. Then, an maximum value and a minimum value, respectively, of the interval between the upper knuckle portion 11 and the upper knuckle portion 11 or the interval between the upper knuckle portion 11 and the lower knuckle portion 12 are 5.5 pieces and 5.0 pieces, respectively, of the upper warp yarn 5 and the difference therebetween is 0.5 pieces. Accordingly, it can be seen that the upper knuckle portion 11 and the lower knuckle portion 12 are arranged substantially uniformly in the weft yarn direction. In addition, it can be seen that, in the adjacent weft yarns, the lower knuckle portions 12 are arranged at an interval corresponding to one or more pieces of the lower warp yarn 7 and thus are not adjacent to each other but distributedly arranged.

Figures 5A, 5B, 5C:
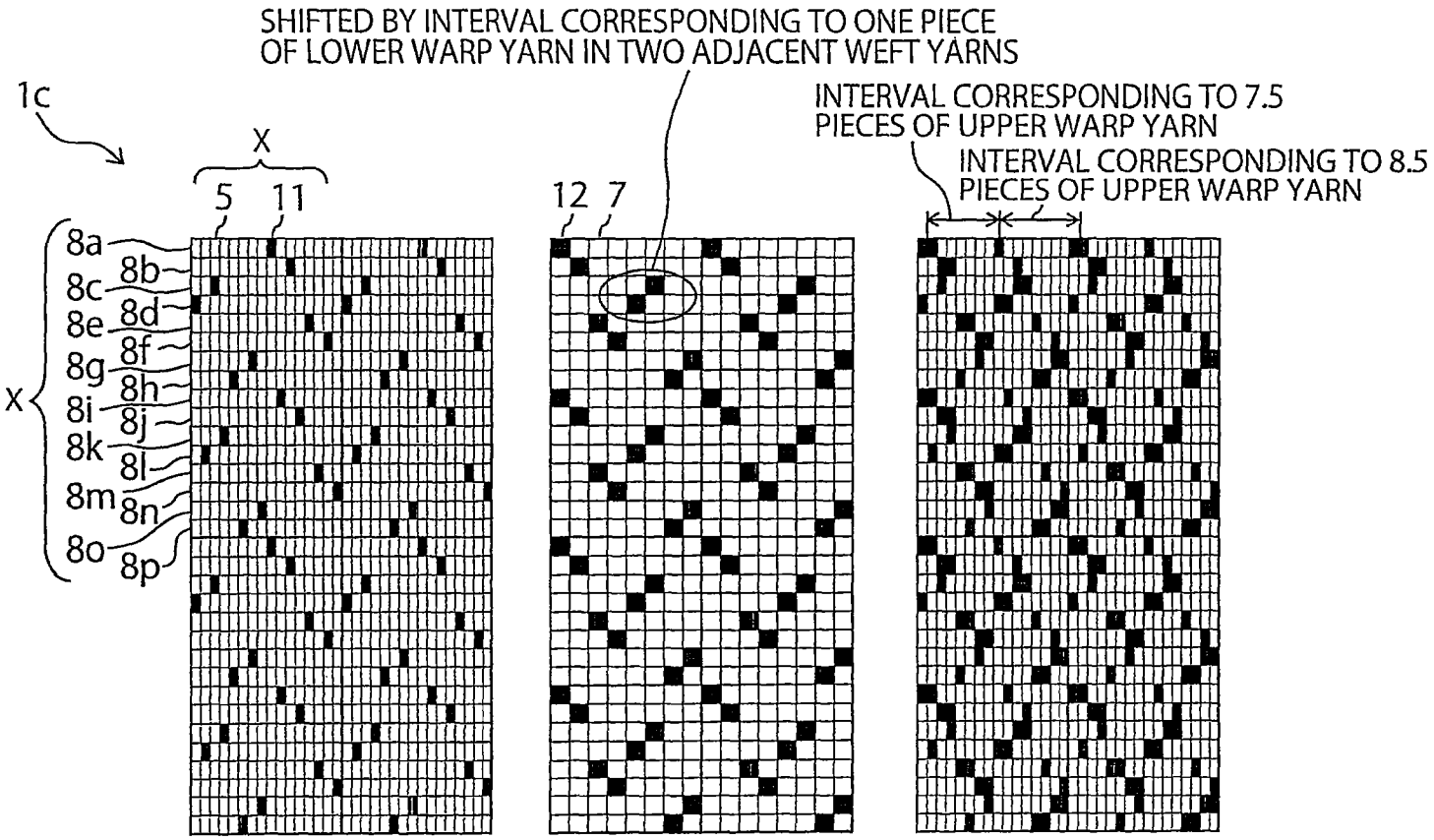
FIGS. 5A to 5C are schematic diagrams indicating positional relationships between knuckle portions of a base fabric in still another example of the felt according to the present invention.

FIGS. 5A to 5C are schematic diagrams indicating positional relationships between the upper knuckle portion 11 on the wet paper web surface side 4 of a base fabric is and the lower knuckle portion 12 on the running surface side 6 thereof in still another example of the felt according to the present invention. As depicted in FIG. 5C, in each of the weft yarns 8*a* to 8*p* in the unit texture structure, the base fabric 1*c* has one upper knuckle portion 11 formed by each of the weft yarns 8*a* to 8*p* and the upper warp yarn 5 and one lower knuckle portion 12 formed by each of the weft yarns 8*a* to 8*p* and the lower warp yarn 7. Then, a maximum value and a minimum value, respectively, of the interval between the upper knuckle portion 11 and the lower knuckle portion 12 are 8.5 pieces and 7.5 pieces, respectively, of the upper warp yarn 5 and the difference therebetween is 1.0 piece. Accordingly, it can be seen that the upper knuckle portion 11 and the lower knuckle portion 12 are arranged substantially uniformly in the weft yarn direction. In addition, in the adjacent weft yarns, the lower knuckle portions 12 can be seen to be distributedly arranged as a pair of two adjacent ones shifted from each other by an interval corresponding to one piece of the lower warp yarn 7.

Figures 6A, 6B, 6C:
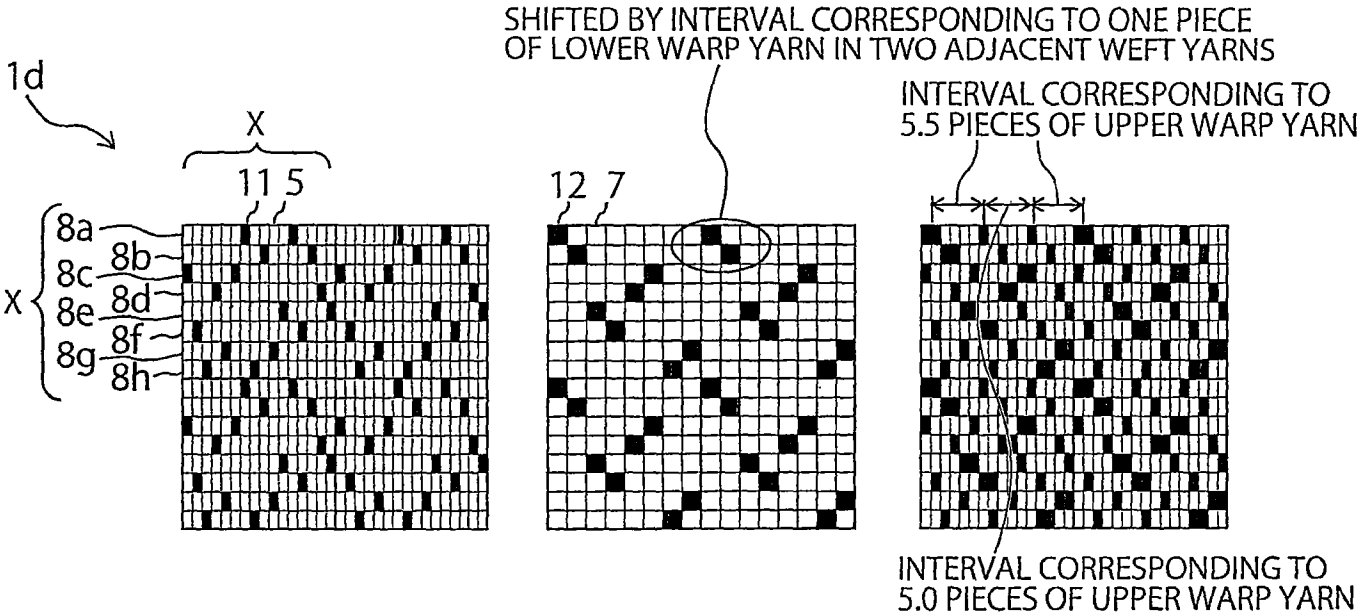
FIGS. 6A to 6C are schematic diagrams indicating positional relationships between knuckle portions of a base fabric in still another example of the felt according to the present invention.

FIGS. 6A to 6C are schematic diagrams indicating positional relationships between the upper knuckle portion 11 on the wet paper web surface side 4 of a base fabric 1*d* and the lower knuckle portion 12 on the running surface side 6 thereof in still another example of the felt according to the present invention. As depicted in FIG. 6C, in each of the weft yarns 8*a* to 8*h* in the unit texture structure, the base fabric 1*d* has two upper knuckle portions 11 formed by each of the weft yarns 8*a* to 8*h* and the upper warp yarn 5 and one lower knuckle portion 12 formed by each of the weft yarns 8*a* to 8*h* and the lower warp yarn 7. Then, a maximum value and a minimum value, respectively, of the interval between the upper knuckle portion 11 and the upper knuckle portion 11 or the interval between the upper knuckle portion 11 and the lower knuckle portion 12 are 5.5 pieces and 5.0 pieces, respectively, of the upper warp yarn 5 and the difference therebetween is 0.5 pieces. Accordingly, it can be seen that the upper knuckle portion 11 and the lower knuckle portion 12 are arranged substantially uniformly in the weft yarn direction. In addition, in the adjacent weft yarns, the lower knuckle portions 12 can be seen to be distributedly arranged as a pair of two adjacent ones shifted from each other by the interval corresponding to one piece of the lower warp yarn 7.

Figures 7A, 7B, 7C:
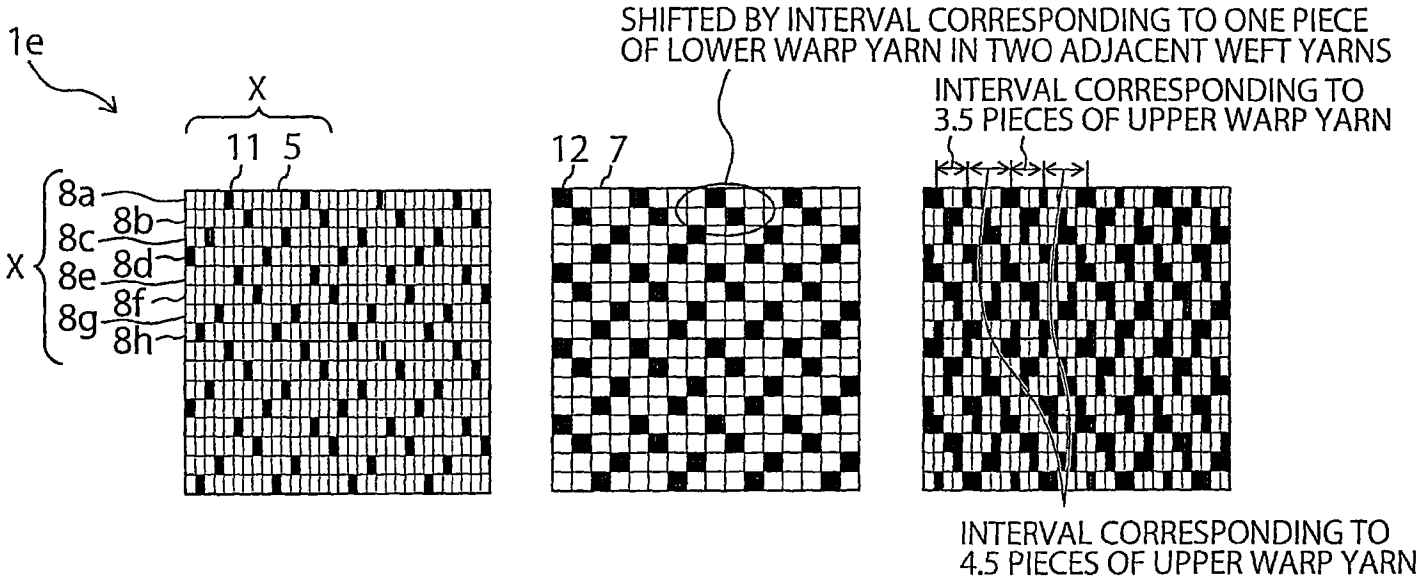
FIGS. 7A to 7C are schematic diagrams indicating positional relationships between knuckle portions of a base fabric in still another example of the felt according to the present invention.

FIGS. 7A to 7C are schematic diagrams indicating positional relationships between the upper knuckle portion 11 on the wet paper web surface side 4 of a base fabric 1*e* and the lower knuckle portion 12 on the running surface side 6 thereof in still another example of the felt according to the present invention. As depicted in FIG. 7C, in each of the weft yarns 8*a* to 8*h* in the unit texture structure, the base fabric 1*e* has two upper knuckle portions 11 formed by each of the weft yarns 8*a* to 8*h* and the upper warp yarn 5 and two lower knuckle portions 12 formed by each of the weft yarns 8*a* to 8*h* and the lower warp yarn 7. Then, a maximum value and a minimum value, respectively, of the interval between the upper knuckle portion 11 and the lower knuckle portion 12 are 4.5 pieces and 3.5 pieces, respectively, of the upper warp yarn 5, respectively, and the difference therebetween is 1.0 piece. Accordingly, it can be seen that the upper knuckle portion 11 and the lower knuckle portion 12 are arranged substantially uniformly in the weft yarn direction. In addition, in the adjacent weft yarns, the lower knuckle portions 12 can be seen to be distributedly arranged as a pair of two adjacent ones shifted from each other by the interval corresponding to one piece of the lower warp yarn 7.

Figures 8A, 8B, 8C:
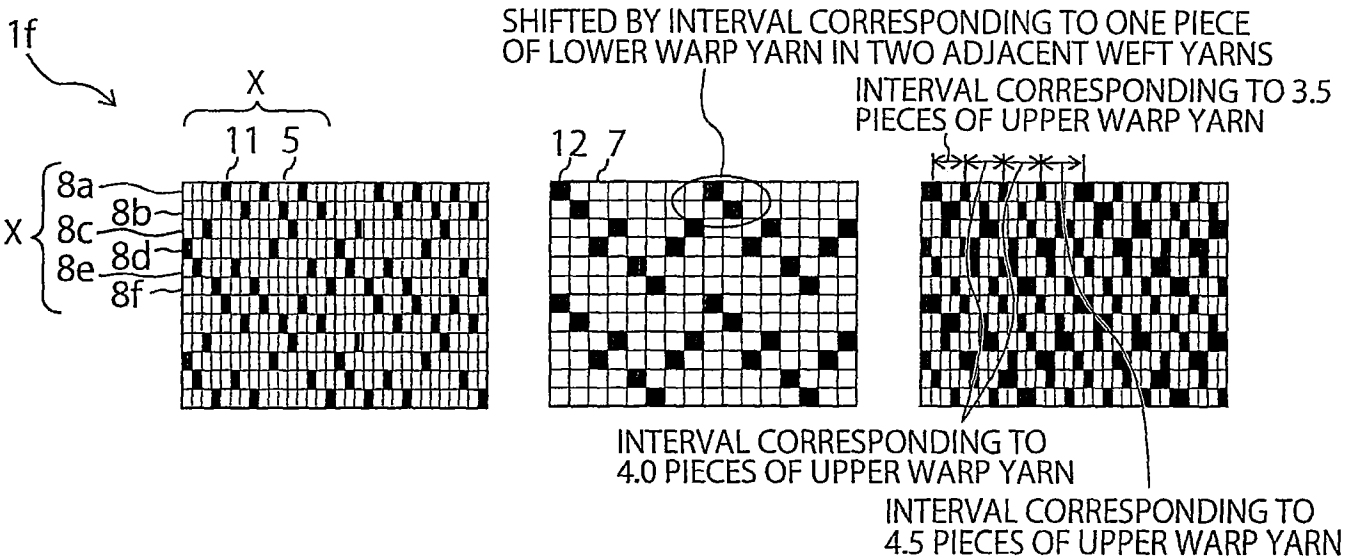
FIGS. 8A to 8C are schematic diagrams indicating positional relationships between knuckle portions of a base fabric in still another example of the felt according to the present invention.

FIGS. 8A to 8C are schematic diagrams indicating positional relationships between the upper knuckle portion 11 on the wet paper web surface side 4 of a base fabric 1*f* and the lower knuckle portion 12 on the running surface side 6 thereof in still another example of the felt according to the present invention. As depicted in FIG. 8C, in each of the weft yarns 8*a* to 8*f* in the unit texture structure, the base fabric 1*f* has three upper knuckle portions 11 formed by each of weft yarns 8*a*, 8*b*, 8*e*, and 8*f* and the upper warp yarn 5 and one lower knuckle portion 12 formed by each of the weft yarns 8*a*, 8*b*, 8*e*, and 8*f* and the lower warp yarn 7, as well as two upper knuckle portions 11 formed by each of the weft yarns 8*c* and 8*d* and the upper warp yarn 5 and two lower knuckle portions 12 formed by each of the weft yarns 8*c* and 8*d* and the lower warp yarn 7. Then, a maximum value and a minimum value, respectively, of the interval between the upper knuckle portion 11 and the upper knuckle portion 11 or the interval between the upper knuckle portion 11 and the lower knuckle portion 12 are 4.5 pieces and 3.5 pieces, respectively, of the upper warp yarn 5 and the difference therebetween is 1.0 piece. Accordingly, it can be seen that the upper knuckle portion 11 and the lower knuckle portion 12 are arranged substantially uniformly in the weft yarn direction. In addition, in the adjacent weft yarns, the lower knuckle portions 12 can be seen to be distributedly arranged as a pair of two adjacent ones shifted from each other by the interval corresponding to one piece of the lower warp yarn 7.

Figures 9A, 9B, 9C:
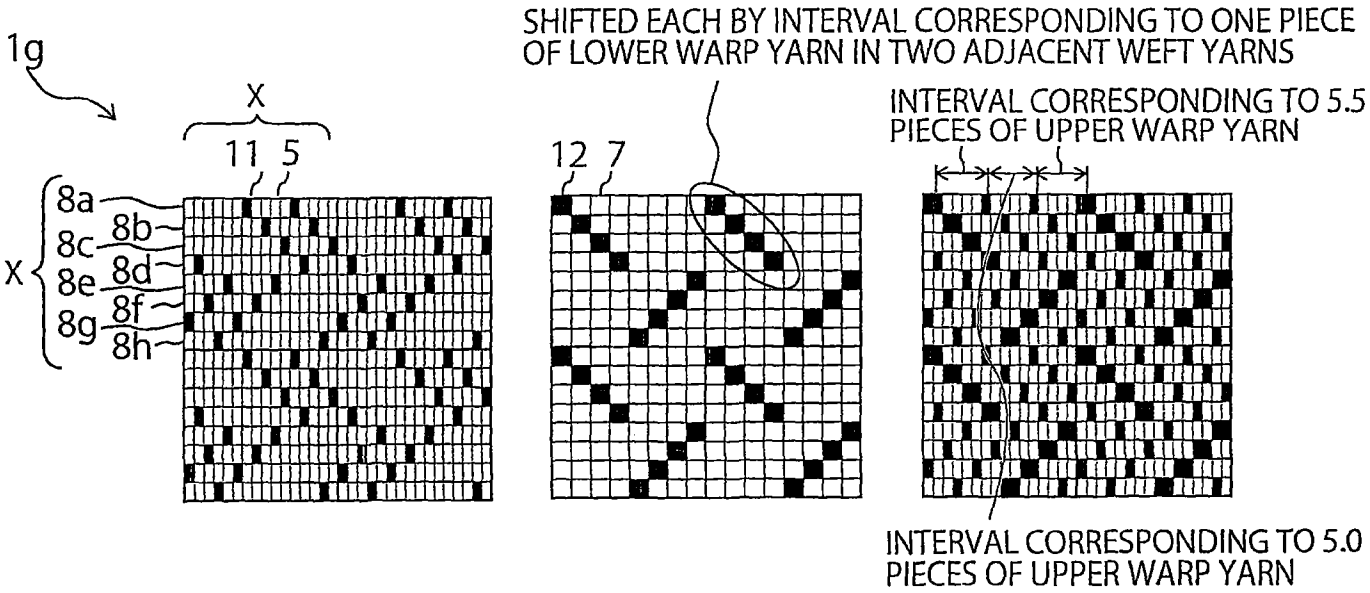
FIGS. 9A to 9C are schematic diagrams indicating positional relationships between knuckle portions of a base fabric in still another example of the felt according to the present invention.

FIGS. 9A to 9C are schematic diagrams indicating positional relationships between the upper knuckle portion 11 on the wet paper web surface side 4 of a base fabric 1*g* and the lower knuckle portion 12 on the running surface side 6 thereof in still another example of the felt according to the present invention. As depicted in FIG. 9C, in the respective weft yarns 8*a* to 8*h* in the unit texture structure, the base fabric 1*g* has two upper knuckle portions 11 formed by each of weft yarns 8*a* to 8*h* and the upper warp yarn 5 and one lower knuckle portion 12 formed by each of the weft yarns 8*a* to 8*h* and the lower warp yarn 7. Then, a maximum value and a minimum value, respectively, of the interval between the upper knuckle portion 11 and the upper knuckle portion 11 or the interval between the upper knuckle portion 11 and the lower knuckle portion 12 are 5.5 pieces and 5.0 pieces, respectively, of the upper warp yarn 5 and the difference therebetween is 0.5 pieces. Accordingly, it can be seen that the upper knuckle portion 11 and the lower knuckle portion 12 are arranged substantially uniformly in the weft yarn direction. In addition, in the adjacent weft yarns, the lower knuckle portions 12 can be seen to be distributedly arranged as a set of four adjacent ones shifted from each other by the interval corresponding to one piece of the lower warp yarn 7.

Hereinabove, there has been described the double warp-single weft texture structure consisting of the weft yarns interwoven so as to be intertwined with both the upper warp yarn 5 and the lower warp yarn 7 in the base fabric of the felt of the present invention. Next, a description will be given of a triple warp-single weft texture structure in a base fabric of the felt thereof, which consists of the upper warp yarn 5, the lower warp yarn 7, an intermediate warp yarn 9 arranged therebetween, and weft yarns interwoven so as to be intertwined with each of the upper warp yarn 5, the lower warp yarn 7, and the intermediate warp yarn 9.

Figure 10:
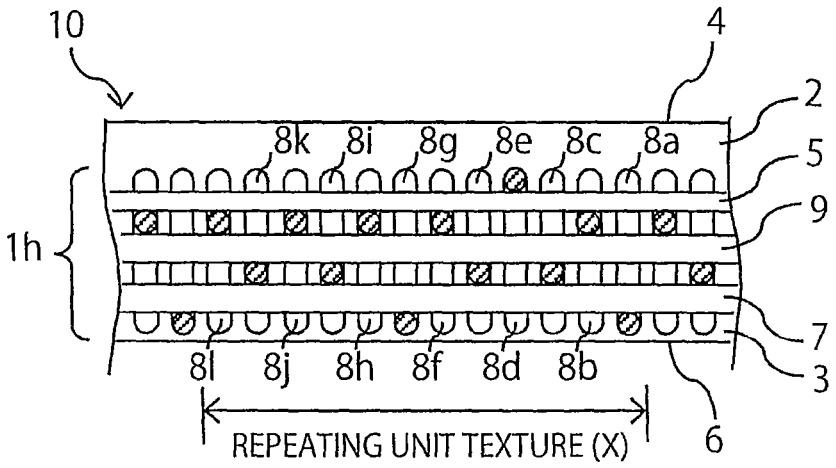
FIG. 10 is a cross-sectional view of a warp yarn direction in another example of the felt according to the present invention.
Figure 11A:
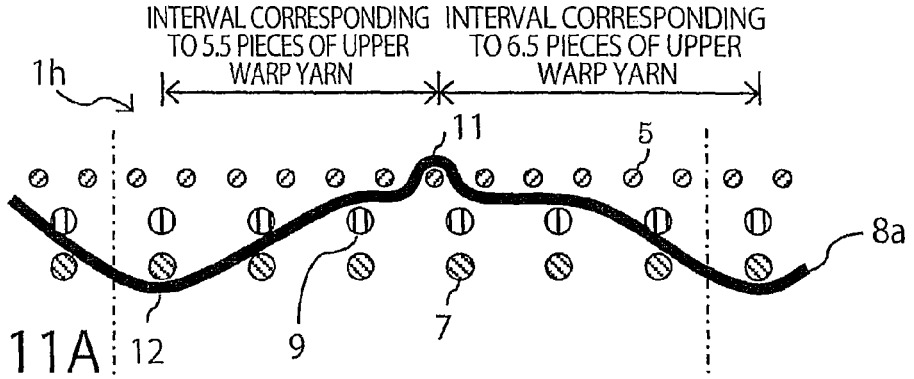
FIGS. 11A to 11L are cross-sectional views of weft yarn directions of a base fabric depicted in FIG. 10.
Figure 11B:
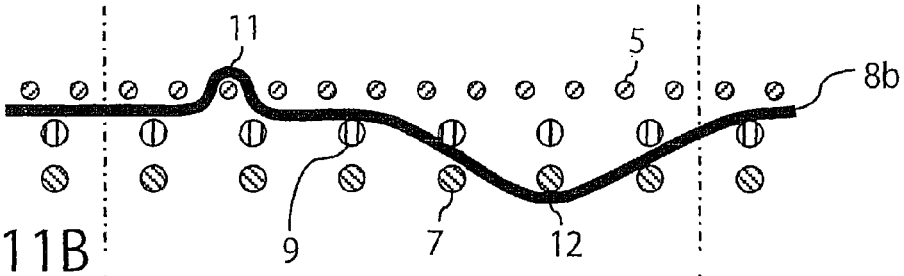
Figure 11C:
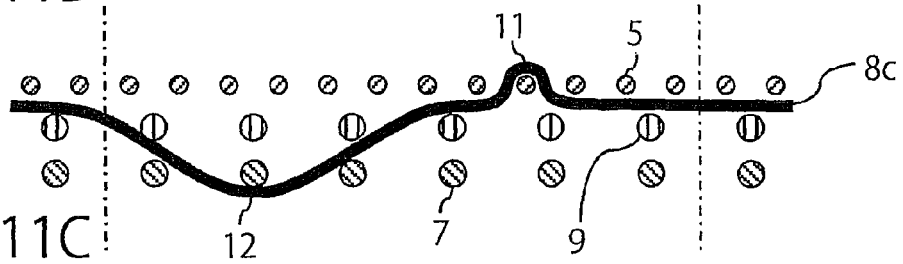
Figure 11D:
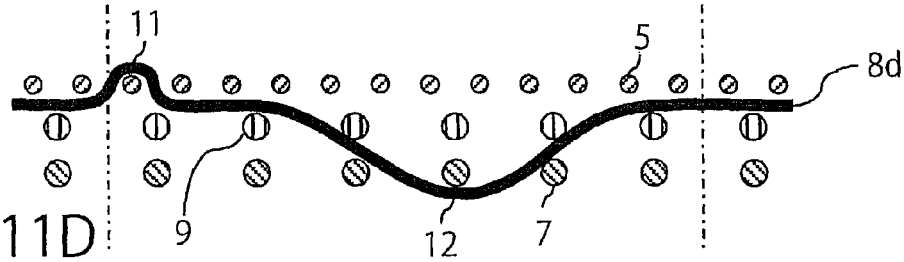
Figure 11E:
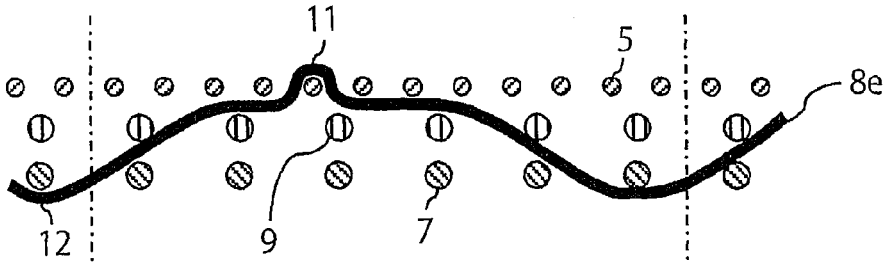
Figure 11F:
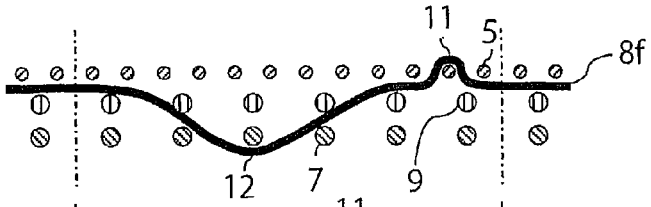
Figure 11G:
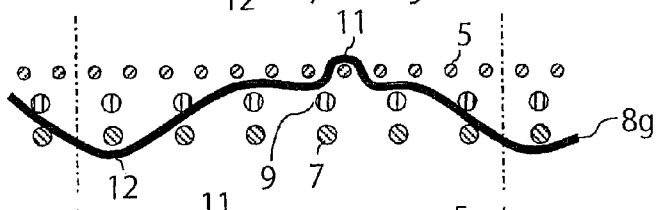
Figure 11H:
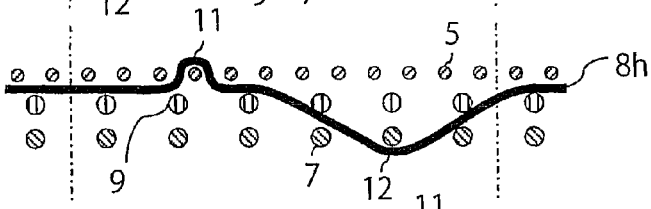
Figure 11I:
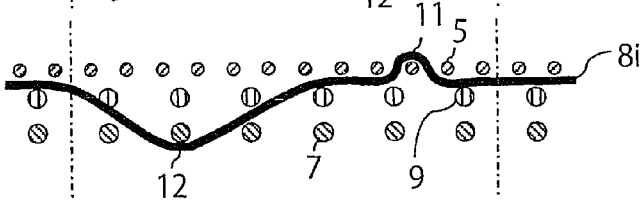
Figure 11J:
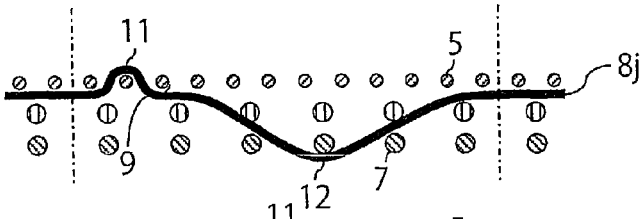
Figure 11K:
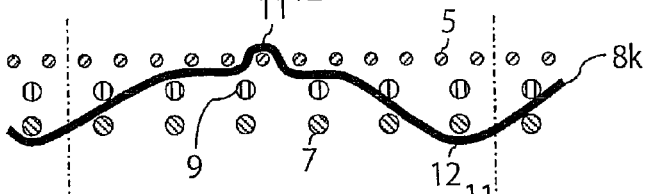
Figure 11L:
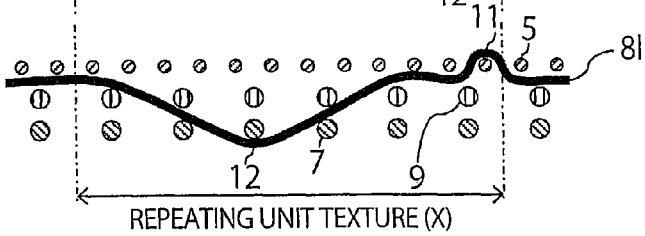
Figures 12A, 12B, 12C:
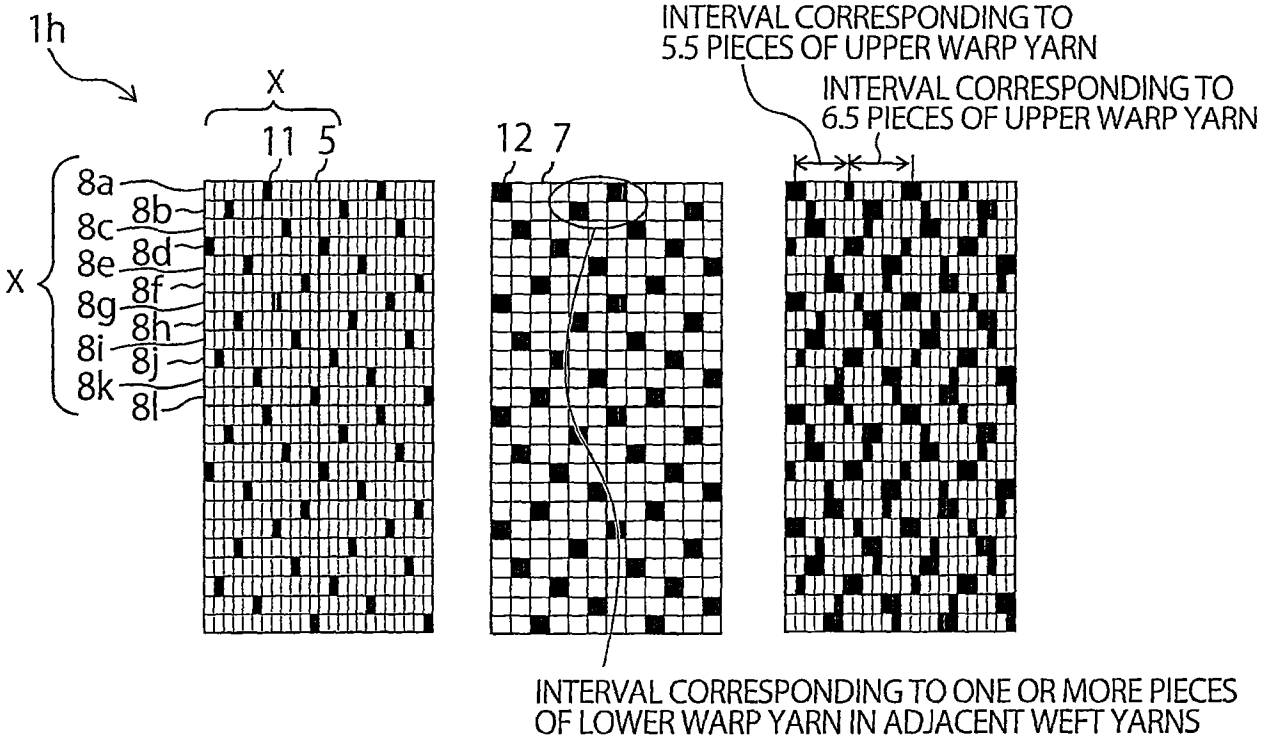
FIGS. 12A to 12C are schematic diagrams indicating positional relationships between knuckle portions of the base fabric depicted in FIG. 10.

FIG. 10 is a cross-sectional view of a warp yarn direction in a still another example of the felt according to the present invention. FIGS. 11A to 11L are cross-sectional views of weft yarn directions of a base fabric of the felt depicted in FIG. 10. FIGS. 12A, 12B, and 12C, respectively, are schematic diagrams indicating an upper knuckle portion 11 on a wet paper web side of the fabric depicted in FIG. 10, a lower knuckle portion 12 on a running surface side thereof, and a positional relationship between the upper knuckle portion 11 on the wet paper web side thereof and the lower knuckle portion 12 on the running surface side thereof.

A base fabric 1*h* depicted in FIG. 10 is a base fabric in which the intermediate warp yarn 9 is arranged in the base fabric is depicted in FIG. 1. The base fabric 1 has the upper warp yarn 5 on the wet paper web side 4 where a wet paper web will be placed, the lower warp yarn 7 on the running surface side 6 that will contact with rolls and the like of a papermaking machine, and the intermediate warp yarn 9 arranged between the upper warp yarn 5 and the lower warp yarn 7 to have a triple warp-single weft texture structure consisting of the weft yarns 8*a* to 8*l* interwoven so as to be intertwined with each of the upper warp yarn 5, the lower warp yarn 7, and the intermediate warp yarn 9. The weft yarns 8*a* to 8*l*, respectively, are interwoven as depicted in FIGS. 11A to 11L, respectively, to form a unit texture by the 12 pieces of the weft yarns. The unit texture (X) is repeated in a warp yarn direction and a weft yarn direction to form a texture structure.

As depicted in FIG. 12C, in each of the weft yarns 8*a* to 8*l* in the unit texture structure, a base fabric 1*h* has one upper knuckle portion 11 formed by each of the weft yarns 8*a* to 8*l* and the upper warp yarn 5 and one lower knuckle portion 12 formed by each of the weft yarns 8*a* to 8*l* and the lower warp yarn 7. Then, a maximum value and a minimum value, respectively, of the interval between the upper knuckle portion 11 and the lower knuckle portion 12 are 6.5 pieces and 5.5 pieces, respectively, of the upper warp yarn 5 and the difference therebetween is 1.0 piece. Accordingly, it can be seen that the upper knuckle portion 11 and the lower knuckle portion 12 are substantially uniformly arranged in the weft yarn direction. In addition, in the adjacent weft yarns, it can be seen that the lower knuckle portions 12 are arranged at an interval corresponding to one or more pieces of the lower warp yarn 7 and thus are not adjacent to each other but distributedly arranged. The arrangements of the upper knuckle portion 11 and the lower knuckle portion 12 in FIGS. 3 and 12 are the same. Additionally, in FIGS. 4 to 9 also, it is possible to form a triple warp-single weft texture structure in which the intermediate warp yarn 9 is arranged while maintaining the same arrangements of the upper and the lower knuckle portions 11 and 12.

By using, for felt, the base fabric having the unit texture in which the upper and the lower knuckle portions 11 and 12 are arranged as in the above application examples, there can be provided a felt that can equalize a pressure state under pressurization by a press so as to smooth the surface of a wet paper web without marking on the surface thereof and allow water to be uniformly squeezed out from the wet paper web without crushing the wet paper web.

FIGS. 13-13C to 15A-15C are schematic diagrams indicating positional relationships between knuckle portions of base fabrics of felts according to conventional arts.

Figures 13A, 13B, 13C:
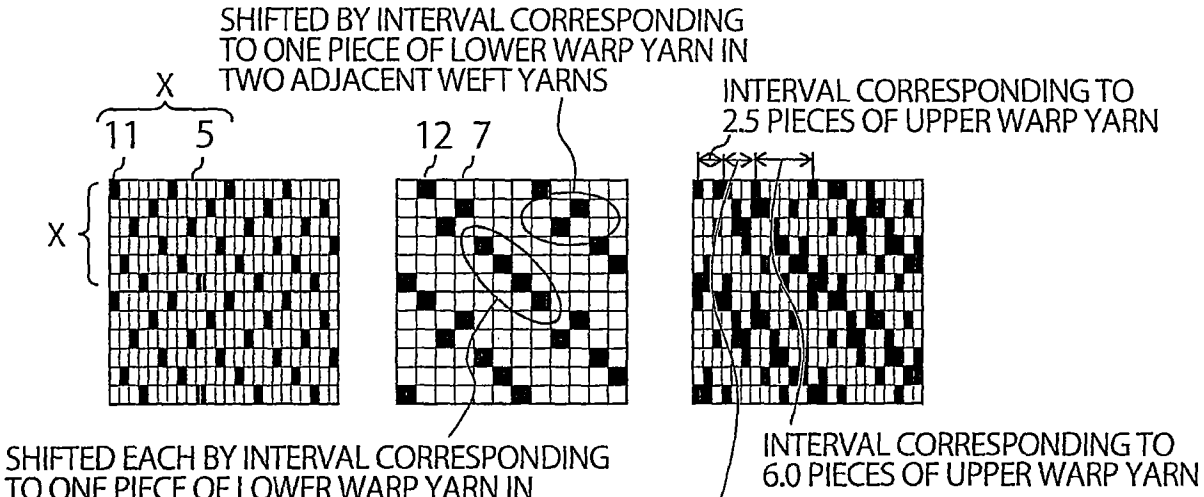
FIGS. 13A to 13C are schematic diagrams indicating positional relationships between knuckle portions of a base fabric of a felt according to a conventional art.

A base fabric depicted in FIGS. 13A to 13C has 6 pieces of weft yarn in a unit texture, in which there are provided two upper knuckle portions 11 formed by each of the weft yarns and the upper warp yarn 5 and one lower knuckle portion 12 formed by each of the weft yarns and the lower warp yarn 7. Then, as depicted in FIG. 13C, a maximum value and a minimum value, respectively, of the interval between the upper knuckle portion 11 and the upper knuckle portion 11 or the interval between the upper knuckle portion 11 and the lower knuckle portion 12 are 6.0 pieces and 2.5 pieces, respectively, of the upper warp yarn and the difference therebetween is 3.5 pieces. Accordingly, in the weft yarn direction, the upper and the lower knuckle portions 11 and 12 are found to be nonuniformly distributed and arranged. In addition, in the adjacent weft yarns, there are present both the pair of two adjacent lower knuckle portions 12 shifted from each other by an interval corresponding to one piece of the lower warp yarn and the set of four adjacent weft yarns shifted from each other by the interval corresponding to one piece of the lower warp yarn. As a result, the nonuniformity of density between the upper and the lower knuckle portions 11 and 12 is intensely exhibited in an oblique direction of the base fabric, affecting the equalization of the pressure state under pressurization by a press, the suppression of marking on the surface of a wet paper web, the smoothness of the surface thereof, and uniform water-squeezability in the wet paper web.

Figures 14A, 14B, 14C:
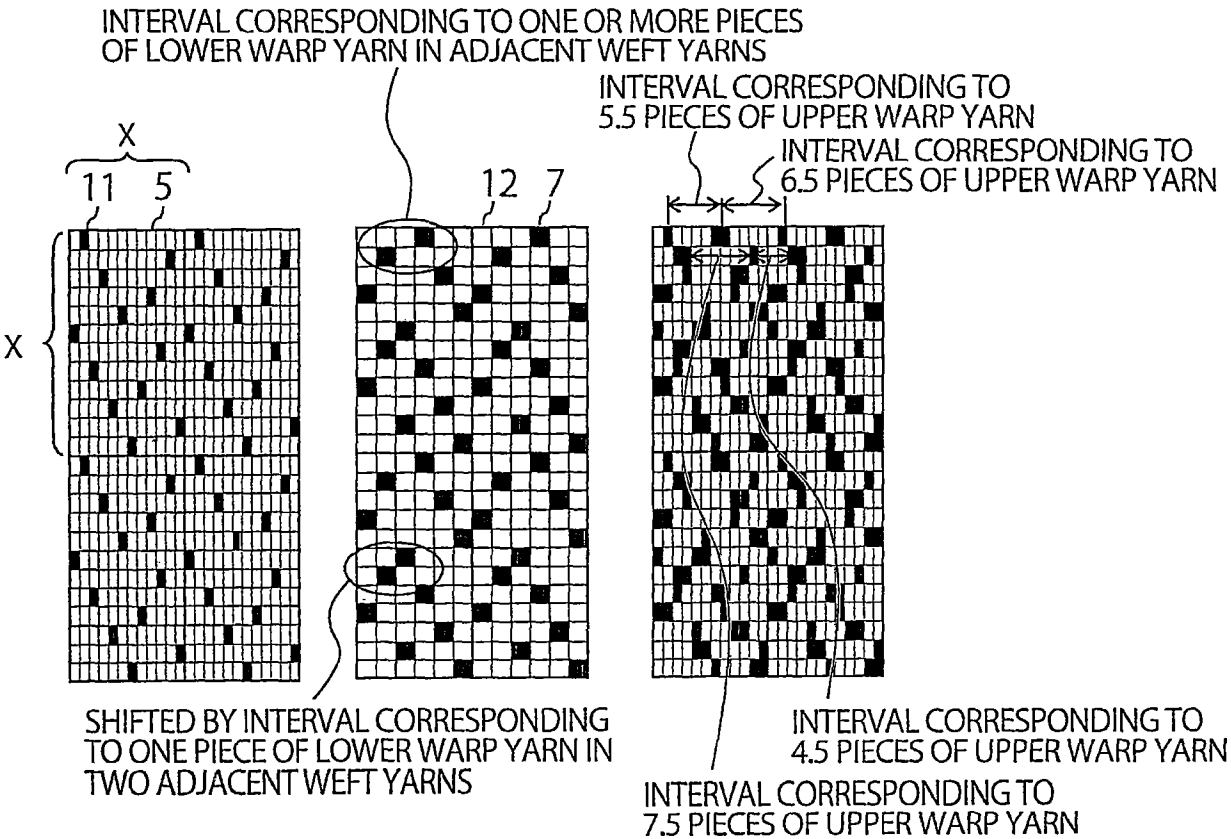
FIGS. 14A to 14C are schematic diagrams indicating positional relationships between knuckle portions of a base fabric of a felt according to a conventional art.

A base fabric depicted in FIGS. 14A to 14C has 12 pieces of weft yarn in a unit texture, in which there are provided one upper knuckle portion 11 formed by each of the weft yarns and the upper warp yarn 5 and one lower knuckle portion 12 formed by each of the weft yarns and the lower warp yarn 7. Then, as depicted in FIG. 14C, regarding a maximum value and a minimum value, respectively, of the interval between the upper knuckle portion 11 and the lower knuckle portion 12, there are both a case of 6.5 pieces and 5.5 pieces, respectively, of the upper warp yarn and a case of 7.5 pieces and 4.5 pieces, respectively, thereof. The respective differences therebetween are 1.0 piece and 3.0 pieces in the respective cases. Therefore, in the weft yarn direction, the upper and the lower knuckle portions 11 and 12 are found to be nonuniformly distributed and arranged. In addition, as depicted in FIG. 14B, regarding the lower knuckle portion 12 formed by each of the weft yarns and the lower warp yarn 7, some lower knuckle portions 12 are arranged at an interval corresponding to one or more pieces of the lower warp yarn 7 and not adjacent to each other and some are present as a pair of two adjacent lower knuckle portions 12 shifted from each other by an interval corresponding to one piece of the lower warp yarn. As a result, the nonuniformity of density is caused in the lower knuckle portions 12 of the base fabric.

Figures 15A, 15B, 15C:
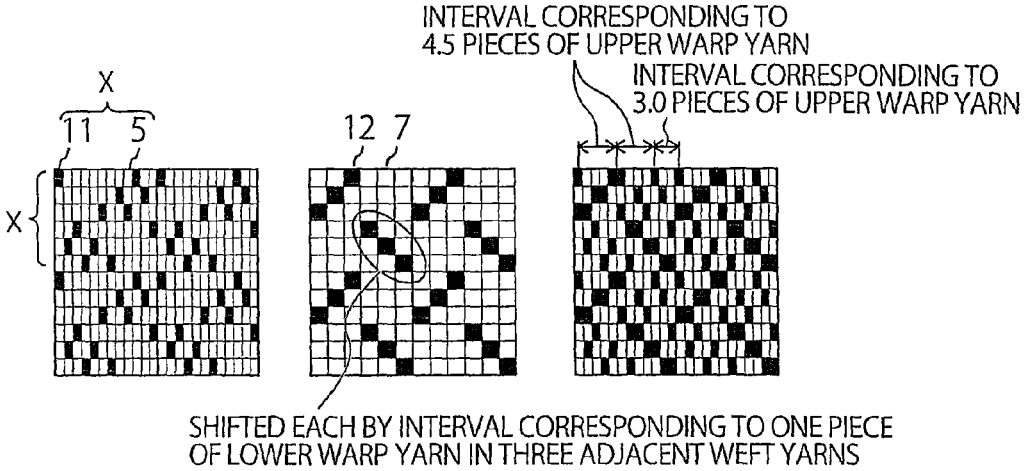
FIGS. 15A to 15C are schematic diagrams indicating positional relationships between knuckle portions of a base fabric of a felt according to a conventional art.

A base fabric depicted in FIGS. 15A to 15C has 6 pieces of weft yarn in a unit texture, in which there are provided two upper knuckle portions 11 formed by each of the weft yarns and the upper warp yarn 5 and one lower knuckle portion 12 formed by each of the weft yarns and the lower warp yarn 7. Then, as depicted in FIG. 15C, a maximum value and a minimum value, respectively, of the interval between the upper knuckle portion 11 and the upper knuckle portion 11 or the interval between the upper knuckle portion 11 and the lower knuckle portion 12 are 4.5 pieces and 3.0 pieces thereof, respectively, of the upper warp yarn and the different therebetween is 1.5 pieces. Accordingly, in the weft yarn directions, the upper and the lower knuckle portions 11 and 12 are found to be nonuniformly distributed and arranged.

Examples of materials usable for the warp yarns, the weft yarns, and batt fiber of the front batt layer 2 and the back batt layer 3 in the base fabrics 1*a* to 1*h* of the present invention exemplified above include polyesters (such as polyethylene terephthalate and polybutylene terephthalate), aliphatic polyamides (such as polyamide 6, polyamide 66, polyamide 11, polyamide 12, and polyamide 612), aromatic polyamides (such as aramid), polyvinylidene fluoride, polypropylene, polyether ether ketone, polytetrafluoroethylene, polyethylene, sheep wool, cotton, wool, and metals. In addition, examples selectable as forms of the warp yarns and the weft yarns used in the base fabrics include any forms used for ordinary papermaking press felts, such as monofilament, twisted monofilament, multifilament, spun yarn, and tow-to-top yarn. Then, the number of times of twisting of the warp yarns and the weft yarns and the densities of the yarns can be selected appropriately according to design to be applied to the base fabric of the papermaking press felt according to the present invention.

In the papermaking press felt according to the present invention, regarding both the upper and the lower knuckle portions of the base fabric of the felt, the intervals of the knuckle portions, the numbers thereof, and the repeating patterns are set as described above so as to further equalize a pressure state under pressurization by a press. In this manner, there can be provided a felt that smoothes the surface of a wet paper web without causing marking on the surface thereof and allows water to be uniformly squeezed out from the wet paper web without crushing the wet paper web.

LIST OF REFERENCE SIGNS

1*a* to 1*h*: Base fabrics
2: Front batt fiber layer
3: Back batt fiber layer
4: Wet paper web side
5: Upper warp yarn
6: Running surface side
7: Lower warp yarn
8*a* to 8*p*: Weft yarns
9: Intermediate warp yarn
10: Papermaking press felt
11: Upper knuckle portion
12: Lower knuckle portion
X: Repeating unit texture

The invention claimed is:

1. A papermaking press felt comprising a base fabric consisted of a woven fabric having a warp-weft texture structure that comprises an upper warp yarn on a wet paper web side of the fabric, a lower warp yarn on a running surface side thereof, and weft yarns interwoven in such a manner as to be intertwined with both the upper and the lower warp yarns, the upper warp yarn being interwoven in a number of pieces larger than the lower warp yarn, wherein the base fabric has, in a unit texture, at least one upper knuckle portion in which the weft yarns bend so as to pass along the upper side of only one piece of the upper warp yarn and at least one lower knuckle portion in which the weft yarns bend so as to pass along the lower side of only one piece of the lower warp yarn, and each weft yarn forms the at least one upper knuckle portion and the at least one lower knuckle portion and a difference between a maximum value and a minimum value of an interval between the upper knuckle portion and the upper knuckle portion, an interval between the upper knuckle portion and the lower knuckle portion, or an interval between the lower knuckle portion and the lower knuckle portion is a value corresponding to 1.0 piece or less of the upper warp yarn, wherein the lower knuckle portions of the base fabric are distributedly arranged as a pair of two adjacent ones shifted from each other by an interval corresponding to one piece of the lower warp yarn.

2. A papermaking press felt comprising a base fabric consisted of a woven fabric having a warp-weft texture structure that comprises an upper warp yarn on a wet paper web side of the fabric, a lower warp yarn on a running surface side thereof, and weft yarns interwoven in such a manner as to be intertwined with both the upper and the lower warp yarns, the upper warp yarn being interwoven in a number of pieces larger than the lower warp yarn, wherein the base fabric has, in a unit texture, at least one upper knuckle portion in which the weft yarns bend so as to pass along the upper side of only one piece of the upper warp yarn and at least one lower knuckle portion in which the weft yarns bend so as to pass along the lower side of only one piece of the lower warp yarn, and each weft yarn forms the at least one upper knuckle portion and the at least one lower knuckle portion and a difference between a maximum value and a minimum value of an interval between the upper knuckle portion and the upper knuckle portion, an interval between the upper knuckle portion and the lower knuckle portion, or an interval between the lower knuckle portion and the lower knuckle portion is a value corresponding to 1.0 piece or less of the upper warp yarn, wherein the lower knuckle portions of the base fabric are distributedly arranged as a set of four adjacent ones shifted from each other by an interval corresponding to one piece of the lower warp yarn.

3. A papermaking press felt comprising a base fabric consisted of a woven fabric having a warp-weft texture structure that comprises an upper warp yarn on a wet paper web side of the fabric, a lower warp yarn on a running surface side thereof, and weft yarns interwoven in such a manner as to be intertwined with both the upper and the lower warp yarns, the upper warp yarn being interwoven in a number of pieces larger than the lower warp yarn, wherein the base fabric has, in a unit texture, at least one upper knuckle portion in which the weft yarns bend so as to pass along the upper side of only one piece of the upper warp yarn and at least one lower knuckle portion in which the weft yarns bend so as to pass along the lower side of only one piece of the lower warp yarn, and each weft yarn forms the at least one upper knuckle portion and the at least one lower knuckle portion and a difference between a maximum value and a minimum value of an interval between the upper knuckle portion and the upper knuckle portion, an interval between the upper knuckle portion and the lower knuckle portion, or an interval between the lower knuckle portion and the lower knuckle portion is a value corresponding to 1.0 piece or less of the upper warp yarn, wherein the base fabric has, in the unit texture, two upper knuckle portions in each of which the weft yarns bend so as to pass along the upper side of only one piece of the upper warp yarn and one lower knuckle portion in which the weft yarns bend so as to pass along the lower side of only one piece of the lower warp yarn.

4. A papermaking press felt comprising a base fabric consisted of a woven fabric having a warp-weft texture structure that comprises an upper warp yarn on a wet paper web side of the fabric, a lower warp yarn on a running surface side thereof, and weft yarns interwoven in such a manner as to be intertwined with both the upper and the lower warp yarns, the upper warp yarn being interwoven in a number of pieces larger than the lower warp yarn, wherein the base fabric has, in a unit texture, at least one upper knuckle portion in which the weft yarns bend so as to pass along the upper side of only one piece of the upper warp yarn and at least one lower knuckle portion in which the weft yarns bend so as to pass along the lower side of only one piece of the lower warp yarn, and each weft yarn forms the at least one upper knuckle portion and the at least one lower knuckle portion and a difference between a maximum value and a minimum value of an interval between the upper knuckle portion and the upper knuckle portion, an interval between the upper knuckle portion and the lower knuckle portion, or an interval between the lower knuckle portion and the lower knuckle portion is a value corresponding to 1.0 piece or less of the upper warp yarn, wherein the base fabric has, in the unit texture, two upper knuckle portions in each of which the weft yarns bend so as to pass along the upper side of only one piece of the upper warp yarn and two lower knuckle portions in each of which the weft yarns bend so as to pass along the lower side of only one piece of the lower warp yarn.

5. A papermaking press felt comprising a base fabric consisted of a woven fabric having a warp-weft texture structure that comprises an upper warp yarn on a wet paper web side of the fabric, a lower warp yarn on a running surface side thereof, and weft yarns interwoven in such a manner as to be intertwined with both the upper and the lower warp yarns, the upper warp yarn being interwoven in a number of pieces larger than the lower warp yarn, wherein the base fabric has, in a unit texture, at least one upper knuckle portion in which the weft yarns bend so as to pass along the upper side of only one piece of the upper warp yarn and at least one lower knuckle portion in which the weft yarns bend so as to pass along the lower side of only one piece of the lower warp yarn, and each weft yarn forms the at least one upper knuckle portion and the at least one lower knuckle portion and a difference between a maximum value and a minimum value of an interval between the upper knuckle portion and the upper knuckle portion, an interval between the upper knuckle portion and the lower knuckle portion, or an interval between the lower knuckle portion and the lower knuckle portion is a value corresponding to 1.0 piece or less of the upper warp yarn, wherein the base fabric has, in the unit texture, three upper knuckle portions in each of which the weft yarns bend so as to pass along the upper side of only one piece of the upper warp yarn and one lower knuckle portion in which the weft yarns bend so as to pass along the lower side of only one piece of the lower warp yarn, and two upper knuckle portions in each of which the weft yarns bend so as to pass along the upper side of only one piece of the upper warp yarn and two lower knuckle portions in each of which the weft yarns bend so as to pass along the lower side of only one piece of the lower warp yarn.

* * * * *